US005833811A

United States Patent [19]

Ando et al.

[11] Patent Number: 5,833,811

[45] Date of Patent: Nov. 10, 1998

[54] HIGH TEMPERATURE REFRACTORY MATERIAL APPLYING APPARATUS FOR THE WALL OF A COKING CHAMBER IN A COKE BATTERY

[75] Inventors: Takeshi Ando, Okayama; Yasuyuki Yamaguchi, Tokyo, both of Japan

[73] Assignee: Kawasaki Steel Corporation, Kobe, Japan

[21] Appl. No.: 691,249

[22] Filed: Aug. 2, 1996

[30] Foreign Application Priority Data

Nov. 2, 1995 [JP] Japan ..... 7-286180

[51] Int. Cl.[6] ..... C10B 1/06; C10B 25/06; C10B 25/24; B05B 1/20

[52] U.S. Cl. ..... 202/248; 239/128; 239/132.3; 239/159; 239/162; 239/165; 239/281; 239/753

[58] Field of Search ..... 202/248; 239/128, 239/132.3, 159, 162, 165, 753, 281

[56] References Cited

U.S. PATENT DOCUMENTS

| | | | |
|---|---|---|---|
| 3,017,121 | 1/1962 | Carlson | 239/159 |
| 3,086,713 | 4/1963 | Moldenhaver | 239/159 |
| 3,534,746 | 10/1970 | Posner . | |
| 4,065,059 | 12/1977 | Jablin | 239/128 |
| 4,201,342 | 5/1980 | Stram | 239/165 |
| 5,547,129 | 8/1996 | Fortunato et al. | 239/132.3 |

FOREIGN PATENT DOCUMENTS

| | | |
|---|---|---|
| 0677566 | 10/1995 | European Pat. Off. . |
| 0210432 | 9/1908 | Germany . |
| 1101356 | 12/1953 | Germany . |

*Primary Examiner*—Patrick D. Niland
*Attorney, Agent, or Firm*—Dvorak & Orum

[57] ABSTRACT

An apparatus for applying a high temperature refractory material to the wall surface of a coking chamber in a coke battery is equipped with: a moving carriage which is provided on the side of a coke pushing machine of the coking chamber and which is free to move back and forth outside the coke battery in the direction of the length of the coking chamber; a horizontal lance which has a trailing end attached to the moving carriage and which is free to move back and forth horizontally from one end to the other end in the direction of the length at the bottom of the coking chamber; a vertical lance which is provided in the direction of the height of the coking chamber at the leading end of the horizontal lance; and spray nozzles for applying a high temperature refractory material which are arranged in tiers in such a manner that they are directed to the wall surface of the coking chamber in the direction of the height of the vertical lance.

14 Claims, 4 Drawing Sheets

HIGH TEMPERATURE REFRACTORY MATERIAL APPLYING APPARATUS FOR THE WALL OF A COKING CHAMBER IN A COKE BATTERY

BACKGROUND OF THE INVENTION

1. Field of the Invention

The present invention relates to a high temperature refractory material applying apparatus for the wall surface of a coking chamber in a coke battery. This apparatus is adapted to apply a high temperature refractory material to the surfaces of the refractory bricks which form a coking chamber in a coke battery and which are exposed to high temperature so as to improve the durability and the resistance of the bricks to gas permeation of the refractory bricks.

2. Description of the Related Art

In general, silica base refractory bricks are used as the refractory bricks of a coking chamber in a coke battery. The silica base refractory bricks are produced by crushing a siliceous material, admixing the crushed siliceous material with water, placing the admixture in a molding box to dry it, then heating the dried admixture at approximately 1200 degrees centigrade. The silica base refractory bricks thus produced are used to build a coke battery which is subjected to drying at a uniform temperature to remove stress before the bricks are subjected to full-scale operation as the refractory bricks for the coke battery.

The refractory bricks have high porosity to enhance the heat insulation thereof; they are formed by inter-particle contact. The surfaces of the bricks, which are smooth in an early period after the coke battery is built, gradually lose their smoothness and become rougher from thermal spalling or thermal cracks due to repeated friction with blended coal or coke which is charged or frequent repetition of a heating and cooling cycle. This leads to increased frictional resistance and accelerated deposition of carbon or ash content, which is produced by treated coal or combustion, on the roughened surface, presenting a problem in the operation of the coke battery.

A coke battery is comprised of many chambers for roasting coal into coke, which chambers are called "coking chambers," and combustion chambers for heating; these two types of chambers are arranged alternately. The coking chambers and the combustion chambers are separated by partitions composed of the silica base refractory bricks as described above. The coking chamber is a rectangular cavity which measures about 6 to 7 meters high, 15 to 16 meters deep, and 40 to 50 cm wide; it is made slightly wider toward an discharging side (hereinafter referred to as "coke discharging side") so as to make it easy to discharge roasted coke from the coke battery.

The material, blended coal, is intermittently supplied by a charging cart through a charging port installed on the ceiling of the coking chamber; before heating, the charged coal is levelled to uniform height by a leveller attached to a pushing machine installed on the opposite side from the coke discharging side. After roasting is finished, both doors are opened, the pushing machine pushes the roasted coal out from the coke discharging side and the fire is quenched by a fire quenching apparatus. The discharged roasted coal is then cooled to turn into product coke.

During the coking process, the tar in the blended coal is gasified and the refractory bricks are exposed to a severe high temperature condition. Further, in recent years, the blended coal is usually dried until the water content thereof which is 8 to 12% is reduced to approximately 5 or 6% before charging it in the coking chamber in order to increase the strength of coke. Thus, the bulk density of the blended coal charged in the coking chamber is increased so as to produce coke with high strength.

However, when the surfaces of the refractory bricks lose their smoothness as described above, the carbon in the blended coal which is produced in the course of coking clings to the surfaces of the bricks. This makes the surfaces even rougher and the carbon sticking to the surfaces leads to a decreased width of the coking chamber. As a result, there is a higher resistance to the pushing out of the coke, developing a serious problem in coking operation. If the coke is forcibly pushed out, the parts called "joints" which fills the gaps between bricks are damaged, causing a raw gas to flow out from the coking chamber into the combustion chamber. This in turn causes dark smoke to be generated through a chimney, adding to pollution.

As corrective measures for the problem mentioned above, after discharging coke, the buildup on the brick surfaces in the high temperature coking chamber is manually removed using metal bars or the carbon adhered to the bricks is burned to remove it by blowing air or oxygen as disclosed, for example, in Japanese Patent Laid-Open Nos. 2-24392 and 3-111487. There is also a traditional method for preventing carbon from adhering to the surfaces of the refractory bricks. According to the traditional method, tar, petroleum pitch or the like is applied to the surfaces of refractory bricks to put them in a reduced state, thereby lowering the melting point of the silica content on the brick surfaces to melt it so as to make the brick surfaces smooth. There has also been proposed recently a method for forming a dense surface layer by melting and injecting fine-powder silicon oxide or chromium oxide to the surfaces of refractory bricks, which is known as the plasma spraying method (see Japanese Patent Laid-Open No. 2-160896). The aforesaid prior arts, however, do not refer to any specific apparatus for applying a refractory material to the wall surface of a coking chamber in a coke battery.

The applicant has proposed a high temperature refractory material surface treatment method in Japanese Patent Application No. 6-274255. According to this method, an organosilicic compound treatment material composed of particular ingredients is applied to the surfaces of refractory bricks by using a spray nozzle to cause reaction between a refractory brick surface layer and a melt coating layer and also to cause sodium to evaporate, thereby successfully producing a treated layer which has a high silica purity, smooth surface, and high strength.

However, although it is relatively easy to apply the organosilicic treatment material to the vicinity of the door of the coking chamber in the coke battery by using the spray nozzle, it is difficult to ensure stable application of the treatment material to the central part of the coking chamber. Hence, there has been a demand for achieving an apparatus for applying a refractory material to the whole area of the coking chamber including the central part of the wall surface of the coking chamber.

SUMMARY OF THE INVENTION

Accordingly, it is an object of the present invention to provide an apparatus for applying a high temperature refractory material to the wall surface of the coking chamber in a coke battery, which permits easy, stable application a refractory material to the entire area of a coking chamber without the need of a significant change of existing equipment.

The invention has been accomplished by conducting various studies on an apparatus for applying a high temperature refractory material to the wall surface of a coking chamber. The following summarizes the invention.

To fulfill the object of the invention, according to a first aspect of the invention, there is provided an apparatus for applying a high temperature refractory material to the wall surface of a coking chamber in a coke battery, comprising: a moving carriage which is provided on the side of a coke pushing machine of the coking chamber and which is allowed to move back and forth outside the coke battery in the direction of the length of the coking chamber; a horizontal lance which has a trailing end thereof attached to the moving carriage and which is allowed to move back and forth horizontally from one end to the other end in the direction of the length at the bottom of the coking chamber; a vertical lance which is provided in the direction of the height of the coking chamber at the leading end of the horizontal lance; and spray nozzles for applying the high temperature refractory material which is arranged in multiple tiers in such a manner that they are directed to the wall surface of the coking chamber in the direction of the height of the vertical lance.

According to a second aspect of the invention, there is provided an apparatus for applying the high temperature refractory material to the wall surface of the coking chamber in the coke battery according to the first aspect of the invention, further comprising a plurality of slide shoes which are disposed on the bottom of the horizontal lance in the direction of the length thereof so that they slidably come in contact with the battery bottom to support the horizontal lance when the horizontal lance is inserted in the coking chamber.

According to a third aspect of the invention, there is provided an apparatus for applying the high temperature refractory material to the wall surface of the coking chamber in the coke battery according to the first or second aspect of the invention, further comprising guide plates which are provided on both ends of the vertical lance in the direction of the width thereof so as to guide the horizontal lance in the direction of the width of the battery when the horizontal lance is inserted in the coking chamber.

According to a fourth aspect of the invention, there is provided an apparatus for applying the high temperature refractory material to the wall surface of the coking chamber in the coke battery according to the first, second and/or third aspect of the invention, wherein the horizontal lance and the vertical lance are water-cooled.

According to a fifth aspect of the invention, there is provided an apparatus for applying the high temperature refractory material to the wall surface of the coking chamber in the coke battery according to the first, second, third and/or fourth aspect of the invention, wherein the moving carriage is provided in such a manner that it may move back and forth along a fixed guide rail outside the coke battery.

According to a sixth aspect of the invention, there is provided an apparatus for applying the high temperature refractory material to the wall surface of the coking chamber in the coke battery according to the first, second, third, fourth, and/or fifth aspect of the invention, wherein a plurality of carrier rollers are provided to support the horizontal lance so that it may move back and forth outside the battery.

DESCRIPTION OF THE PREFERRED EMBODIMENT

An embodiment of the present invention will be described with reference to the accompanying drawings.

Figure 1:
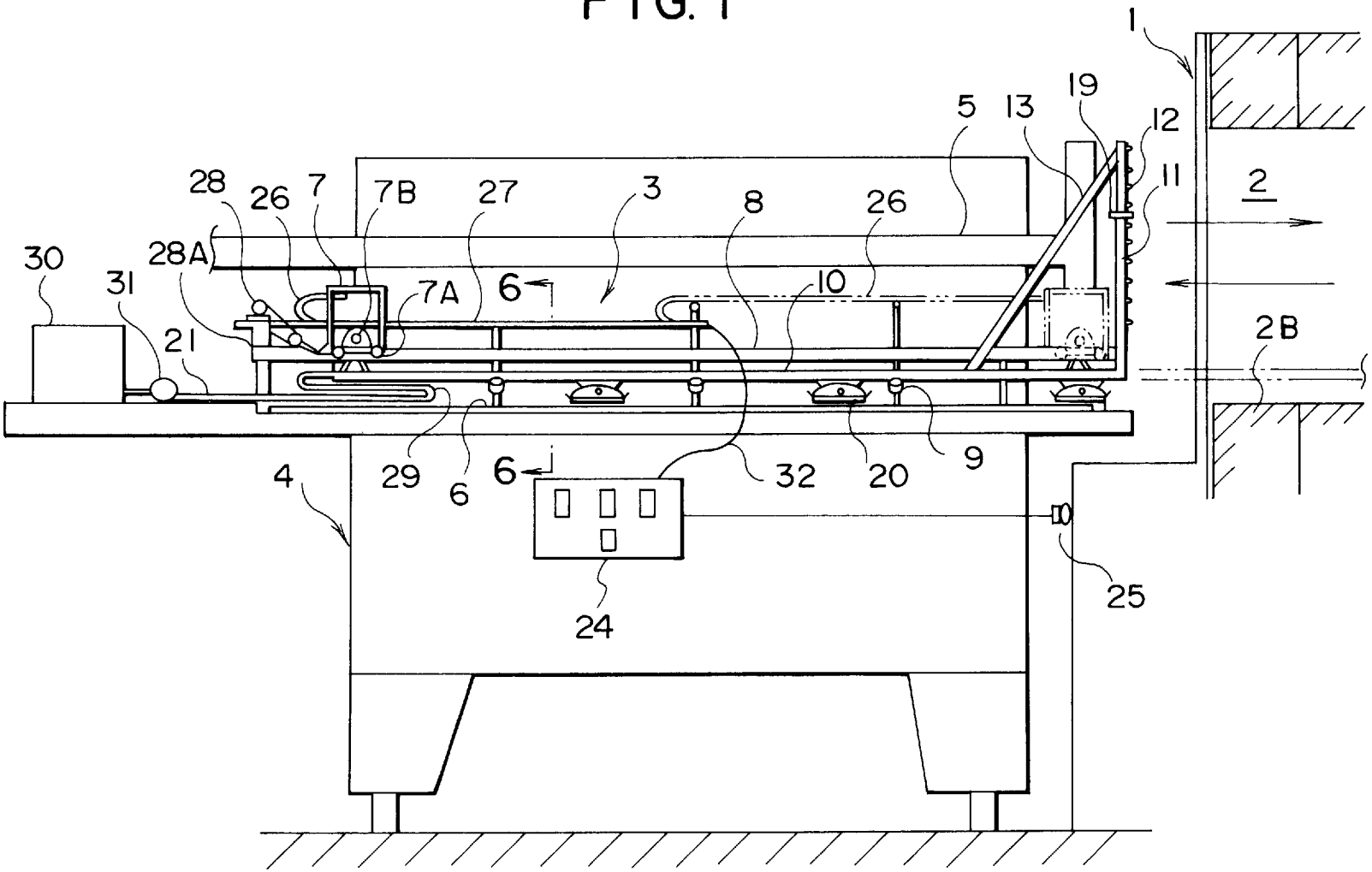
FIG. 1 is a side view showing a high temperature refractory material applying apparatus for the wall surface of a coking chamber in a coke battery in accordance with the present invention.
Figure 2:
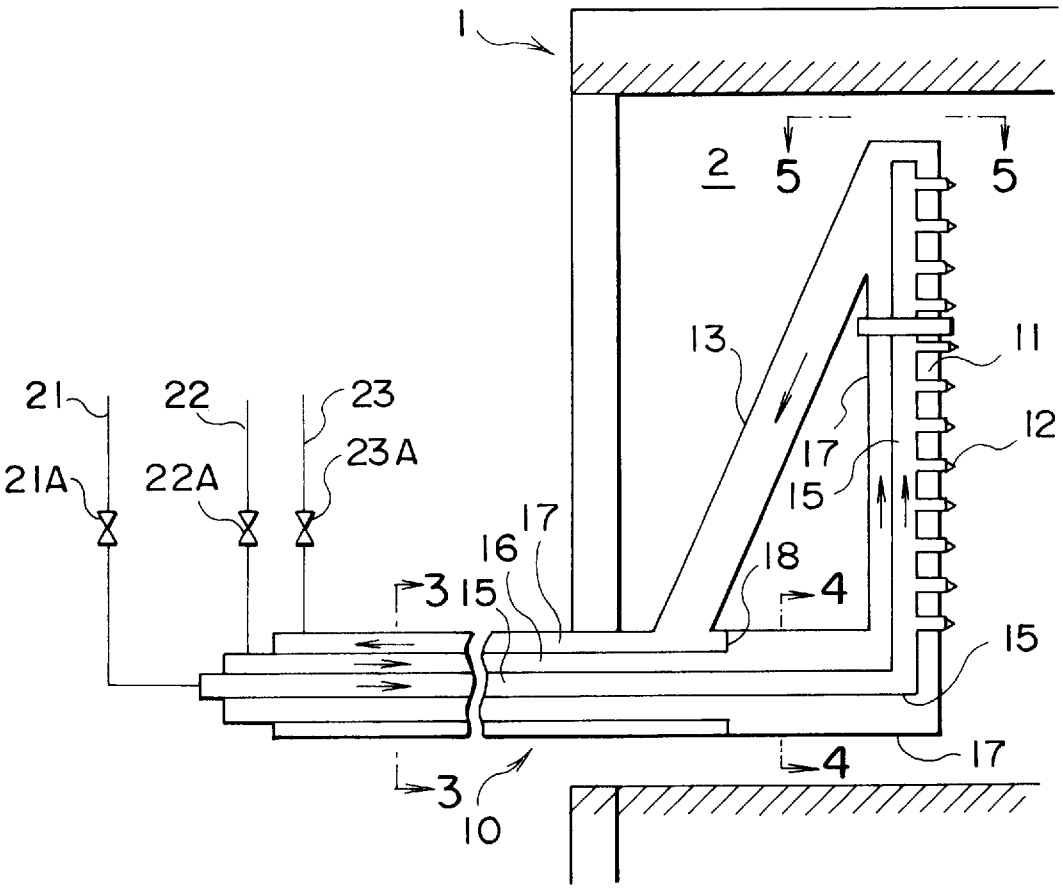
FIG. 2 is a longitudinal sectional view schematically showing the structures of lances provided in the high temperature refractory material applying apparatus in accordance with the present invention.
Figure 3:
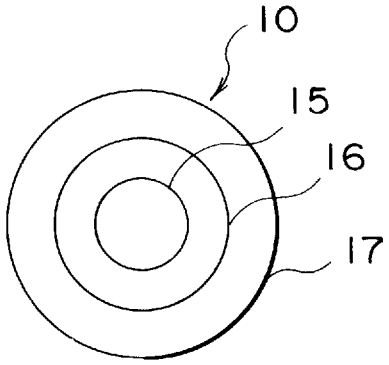
FIG. 3 is a sectional view taken in the direction of the arrows along line A—A of FIG. 2.
Figure 4:
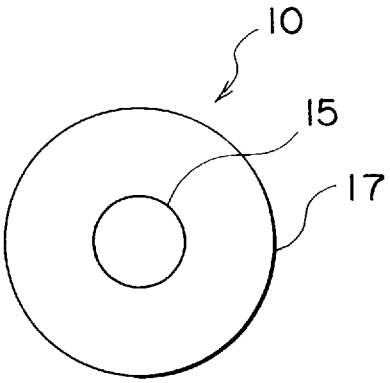
FIG. 4 is a sectional view taken in the direction of the arrows along line B—B of FIG. 2.
Figure 5:
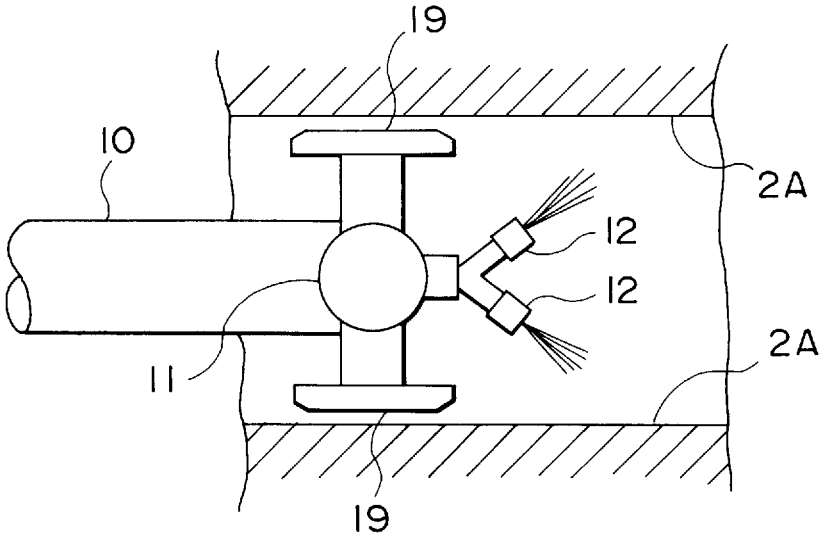
FIG. 5 is a top plan view taken in the direction of the arrows along line C—C of FIG. 2.
Figure 6:
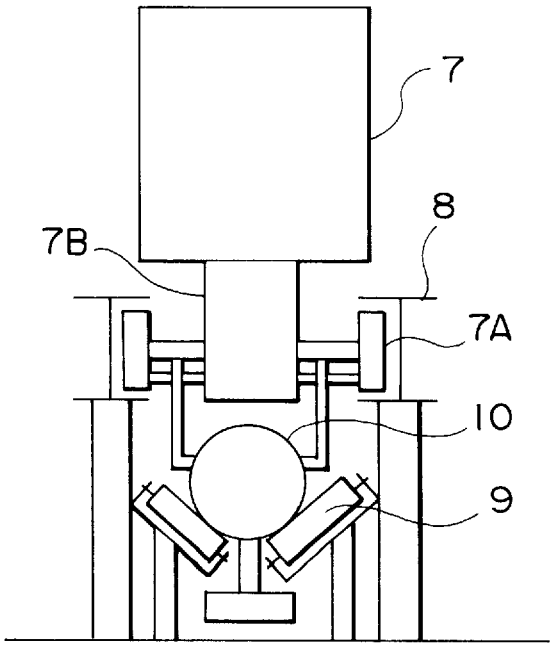
FIG. 6 is a sectional view taken in the direction of the arrows along line A—A of FIG. 1.

FIG. 1 is a side view showing a high temperature refractory material applying apparatus for the wall surface of a coking chamber in a coke battery in accordance with the present invention;

FIG. 2 is a longitudinal sectional view schematically showing the structures of lances provided in the high temperature refractory material applying apparatus in accordance with the present invention;

FIG. 3 is a sectional view taken in the direction of the arrows along line A—A of FIG. 2;

FIG. 4 is a sectional view taken in the direction of the arrows along line B—B of FIG. 2;

FIG. 5 is a top plan view taken in the direction of the arrows along line C—C of FIG. 2; and FIG. 6 is a sectional view taken in the direction of the arrows along line A—A of FIG. 1.

As shown in FIG. 1, a high temperature refractory material applying apparatus 3 of a coking chamber 2 in a coke battery 1 according to the present invention is disposed on a pushing machine 4 which pushes coke out of the coking chamber. The high temperature refractory material applying apparatus 3 is placed by making use of the space on the work floor in the vicinity of a coke pushing ram 5 disposed on the pushing machine 4. This arrangement is convenient from the standpoint of the work procedure because the high temperature refractory material applying apparatus 3 can be operated after the coke is pushed out of the coking chamber 2 by using the pushing machine 4.

To configure the high temperature refractory material applying apparatus 3, a moving carriage 7, which is disposed so that it may move back and forth outside the battery in the direction of the length of the coking chamber 2, is provided on a work floor 6 of the pushing machine 4 in such a manner that it is free to run back and forth along a fixed guide rail 8 installed on the work floor 6 via a wheel 7A as shown in FIG. 1. Reference numeral 7B denotes a driving motor for driving the wheels 7A. The moving carriage 7 is supported by a plurality of carrier rollers 9 provided on the work floor 6; it is attached to the trailing end of a horizontal lance 10, which is free to move back and forth horizontally from one end to the other end of the coking chamber 2, so that the horizontal lance 10 is moved toward and away from the coking chamber 2 as the moving carriage 7 travels.

Provided at the leading end of the horizontal lance 10 is a vertical lance 11 in the direction of the height of the coking chamber 2. In addition, as illustrated in FIG. 5, a two-column high temperature refractory material applying spray nozzle 12 is provided in a multiple tiers with a tilt angle on a horizontal surface in the direction of the height of the vertical lance 11; the spray nozzle 12 is directed toward a wall surface 2A of the refractory bricks of the coking chamber 2. The high temperature refractory material applying spray nozzles 12 are thus arranged in the two columns, facing toward the wall surface 2A of the coking chamber; it is provided in multiple tiers in the direction of height as shown in FIG. 1. It is possible to arrange the high temperature refractory material applying spray nozzles 12 so that the heights of the right and left trains are different to form a zigzag arrangement. The vertical lance 11 is provided with guide plates 19 which are located higher than the center of the vertical lance 11 as shown in FIG. 1 and FIG. 5; they serve to guide the applying apparatus 3 when it is inserted in the coking chamber 2. The middle of the leading end section of the horizontal lance 10 is linked to the distal end of the vertical lance 11 through a drainage slant pipe 13 which provides a drainage channel of cooling water and also enhances the rigidity of the vertical lance 11. The proximal end of the horizontal lance 10 has a triple-pipe structure composed of an inner pipe 15, an intermediate pipe 16, and an outer pipe 17 which are all concentric as shown in FIG. 3; the distal end of the horizontal lance 10 has a double-pipe structure composed of the inner pipe 15 and the outer pipe 17, which are both concentric, as shown in FIG. 4, and it extends to the vertical lance 11 which also has the double-pipe structure.

The proximal end and the leading end of the horizontal lance 10 is separated by an annular partitioner 18 as shown in FIG. 2. The inner pipe 15 of the vertical lance 11 is communicated with the high temperature refractory material spray nozzle 12 arranged in multiple tiers. Further, the outer pipe 17 at the upper end of the vertical lance 11 is communicated with the proximal end of the horizontal lance 10 through the drainage slant pipe 13. A high temperature refractory material supply pipe 21 having a motor-operated valve 21A is connected to the inner pipe 15 of the horizontal lance 10; a water supply pipe 22 having a motor-operated valve 22A is connected to the intermediate pipe 16; and a drainage pipe 23 having a motor-operated valve 23A is connected to the outer pipe 17.

Provided lengthwise on the bottom of the horizontal lance 10 are a plurality of slide shoes 20 which slidably come in contact with a battery bottom 2B when the horizontal lance 10 is inserted in the coking chamber 2. Both ends of the width of the vertical lance 11 are provided with the guide plates 19 for guiding the horizontal lance 10 widthwise in the battery when it is inserted in the coking chamber 2. Hence, even if the battery bottom 2B is not completely level, the vertical lance 11 is maintained nearly vertical.

An pushing machine switch board 24 provided on the pushing machine 4 receives power through a trolley line 25; the pushing machine switch board 24 supplies power and control electric signals to all power-operated devices of the high temperature refractory material applying apparatus 3 via a feeding cable 32. A utility cable bear 26 is connected to the moving carriage 7; the utility cable bear 26 moves while supported by a cable bear support 27 as the moving carriage 7 moves back and forth. The moving carriage 7 also has an emergency drawing device 28 which is installed on a rack 28A disposed on the work floor 6; in case of an emergency such as a failure of the moving carriage 7, the emergency drawing device 28 is used to pull out the moving carriage 7 out of the battery.

A high temperature refractory material and cooling water cable bear 29 is connected to the horizontal lance 10. The high temperature refractory material is supplied into the inner pipe 15 of the horizontal lance 10 via a high temperature refractory material tank 30 and a force feed pump 31.

The operation of the high temperature refractory material applying apparatus 3 in accordance with the present invention will now be described.

After the carbonization of coal by roasting it in the coking chamber 2 is finished, the doors (not shown) which are installed on the machine side and the coke side are removed to push out the coke, which has been produced in the coking chamber 2, from the machine side to the coke side by using the coke pushing ram 5 of the pushing machine 4. Before applying a high temperature refractory material to the refractory brick wall surface 2A of in the coking chamber 2 by using the high temperature refractory material applying apparatus 3, the pushing machine 4 is first moved in the direction of the length of the coke battery 1 and the horizontal lance 10 is positioned to the width center of the coking chamber 2.

Then, the high temperature refractory material is charged through a supply port, not shown, provided on the high temperature refractory material tank 30 and a valve of the supply port is closed. A compound refractory material mixed solution, which is composed of 35 percent of sodium silicate ($SiO_2/Na_2O$ mole ratio=3.5), 5 percent of sodium hydroxide, 7 percent of sodium borate, 3 percent of organosilicic compound [$CH_3$—$Si(OH)_2ONa$], and 50 percent of water, has been used as the high temperature refractory material.

The opening of the motor-operated valves 22A and 23A is then adjusted and cooling water is supplied through the water supply pipe 22. The cooling water passes between the inner pipe 15 and the intermediate pipe 16 at the trailing end of the horizontal lance 10 via the high temperature refractory material and cooling water cable bear 29, and on the distal end side from the annular partitioner 18, it runs between the inner pipe 15 and the outer pipe 16. The cooling water further passes between the inner pipe 15 and the outer pipe 16 of the vertical lance 11 and goes up, then runs in the opposite direction at the proximal end of the horizontal lance 10 via the drainage slant pipe 13 until it reaches the drainage pipe 23.

When the cool state has been secured by running the cooling water through the horizontal lance 10, the vertical lance 11, and the drainage pipe 13, the driving motor 7B provided in the moving carriage 7 is driven for moving the moving carriage 7 at a predetermined speed via the wheel 7A. When the vertical lance 11 provided at the leading end of the horizontal lance 10 reaches the inlet edge of the coking chamber 2, pressure air is supplied to the high temperature refractory material tank 30 to increase the pressure, then the high temperature refractory material is supplied from the tank into the inner pipe 15 of the horizontal lance 10 via the high temperature refractory material and cooling water cable bear 29 for operating the high temperature refractory material supply pipe 21, and it is sprayed through the respective high temperature refractory material applying spray nozzles 12 via the inner pipe 15 of the vertical lance 11.

In this way, the horizontal lance 10 is moved at a predetermined speed from one end to the other end of the coking chamber 2 while spraying the high temperature refractory material through the two-column high temperature refractory material applying spray nozzles 12 to the wall surface 2A composed of the silica base refractory bricks constituting the coking chamber 2. Since the vertical lance 11 is provided with the two-column high temperature refractory material applying spray nozzles 12 in multiple tiers directed toward the wall surface 2A, the high temperature refractory material can be applied uniformly onto the wall surface 2A.

The high temperature refractory material evenly applied to the wall surface 2A composed of the silica base refractory bricks of the coking chamber 2 is the mixture of the ingredients described above. The wall surface 2A of the coking chamber 2 after pushing out the coke is normally maintained at a temperature between 1000 and 1200 degrees centigrade. Therefore, the alkali content of the high temperature refractory material which has the aforesaid mixture ingredients markedly decreases, resulting in the formation of a melt coating layer of the high temperature refractory material which does not cause permeation of alkali to the wall surface 2A composed of the silica base refractory bricks and which exhibits high density, high strength, and smooth glass-like surface with high concentration of silica. The melt coating layer has been formed to a depth ranging from 1.0 to 1.5 mm from the surface of the refractory bricks, the depth being 1.3 mm on average.

As a result, the amount of the solid buildup such as carbon or ash content on the surface of the silica base refractory bricks of the coking chamber 2, after producing twelve batches of coke, has been reduced to 0.1 $g/m^2$ or less in the bricks with surfaces sprayed with the high temperature refractory material in accordance with the present invention. The amount of such buildup to the surfaces of the conventional bricks with nothing applied to the surfaces was 1.9 $g/m^2$. After completion of the application of the high temperature refractory material to the wall surface 2A of the coking chamber 2, the horizontal lance 10 is of course drawn out of the battery.

In this embodiment, the high temperature refractory material applying apparatus 3 is installed on the pushing machine 4; however, the high temperature refractory material applying apparatus 3 may alternatively be mounted on a dedicated moving carriage if necessary. This will enable the high temperature refractory material applying apparatus 3 to be operated independently of the operation of the pushing machine 4.

Thus, the high temperature refractory material applying apparatus for a coking chamber wall surface in a coke battery in accordance with the present invention makes it possible to uniformly apply a high temperature refractory material sprayed through a high temperature refractory material spray nozzles in the direction of height over the whole area from one end to the other end of the coking chamber. Hence, the high temperature refractory material applied to the wall surface of the coking chamber forms a melt coating layer which is smooth and which features high density and high strength.

The result is reduced roughness caused by the adhesion of carbon or ash content, which is generated by the combustion of the blended coal, to the wall surface of the coking chamber. The coke, which has been produced in the coking chamber, can be pushed out easily and the permeation of gas into the bricks comprising the wall surface can be prevented with a consequent extended service life of the refractory bricks of the wall surface, contributing greatly to improved operation of coke batteries.

What is claimed is:

1. An apparatus for applying high temperature refractory material to the wall surface of the coking chamber in a coke battery, comprising:

a moving carriage which is adapted to be used on a side of a coke pushing machine having a work floor and which is allowed to move back and forth outside said coke battery in the direction of the length of said coking chamber;

a horizontal lance which has a trailing end attached to said moving carriage and which is allowed to move back and forth horizontally from one end to the other end in the direction of the length at the bottom of said coking chamber;

a vertical lance which is provided in the direction of the height of said coking chamber at the distal end of said horizontal lance; and spray nozzles for applying the high temperature refractory material and which are arranged in multiple tiers in such a manner that they are directed to the wall surface of said coking chamber in the direction of the height of said vertical lance; and a plurality of slide shoes which are disposed on the bottom of the horizontal lance in the direction of the length thereof so that they slidably engage the bottom of the coke battery to support said horizontal lance when said horizontal lance is inserted in the coking chamber.

2. An apparatus for applying high temperature refractory material to the wall surface of a coking chamber in a coke battery, comprising:

a moving carriage which is adapted to be used on a side of a coke pushing machine having a work floor and which is allowed to move back and forth outside said coke battery in the direction of the length of said coking chamber;

a horizontal lance which has a trailing end attached to said moving carriage and which is allowed to move back and forth horizontally from one end to the other end in the direction of the length at the bottom of said coking chamber;

a vertical lance which is provided in the direction of the height of said coking chamber at the distal end on said horizontal lance;

spray nozzles for applying the high temperature refractory material and which are arranged in multiple tiers in such a manner that they are directed to the wall surface of said coking chamber in the direction of the height of said vertical lance; and guide plates which are provided on both ends of the vertical lance in the direction of the width thereof so as to guide the horizontal lance in the direction of the width of the coke battery when the horizontal lance is inserted in the coking chamber.

3. An apparatus for applying high temperature refractory material to the wall surface of the coking chamber in the coke battery according to claim 1, wherein the horizontal lance and the vertical lance are water-cooled.

4. An apparatus for applying high temperature refractory material to the wall surface of the coking chamber in the coke battery according to claim 1, wherein the moving carriage is adapted to move back and forth along a fixed guide rail outside the coke battery.

5. An apparatus for applying high temperature refractory material to the wall surface of the coking chamber in the coke battery according to claim 1, further comprising guide plates which are provided on both ends of the vertical lance in the direction of the width thereof so as to guide the horizontal lance in the direction of the width of the coke battery when the horizontal lance is inserted in the coking chamber.

6. An apparatus for applying high temperature refractory material to the wall surface of the coking chamber in the coke battery according to claim 1, wherein the horizontal lance and the vertical lance are water-cooled.

7. An apparatus for applying high temperature refractory material to the wall surface of the coking chamber in the coke battery according to claim 2, wherein the horizontal lance and the vertical lance are water-cooled.

8. An apparatus for applying high temperature refractory material to the wall surface of the coking chamber in the coke battery according to claim 1, wherein the moving carriage is adapted to move back and forth along a fixed guide rail outside the coke battery.

9. An apparatus for applying high temperature refractory material to the wall surface of the coking chamber in the coke battery according to claim 2, wherein the moving carriage is adapted to move back and forth along a fixed guide rail outside the coke battery.

10. An apparatus for applying high temperature refractory material to the wall surface of the coking chamber in the coke battery according to claim 3, wherein the moving carriage is adapted to move back and forth along a fixed guide rail outside the coke battery.

11. An apparatus for applying high temperature refractory material to the wall surface of the coking chamber in the coke battery according to claim 1, wherein the moving carriage is supported by a plurality of carrier rollers attached to the work floor and wherein the carriage is attached to the trailing end of the horizontal lance, thereby supporting the horizontal lance for movement back and forth outside the coke battery.

12. An apparatus for applying high temperature refractory material to the wall surface of the coking chamber in the coke battery according to claim 2, wherein the moving carriage is supported by a plurality of carrier rollers attached to the work floor and wherein the carriage is attached to the trailing end of the horizontal lance, thereby supporting the horizontal lance for movement back and forth outside the coke battery.

13. An apparatus for applying high temperature refractory material to the wall surface of the coking chamber in the coke battery according to claim 3, wherein a plurality of carrier rollers are provided to support the horizontal lance for movement back and forth outside the coke battery.

14. An apparatus for applying high temperature refractory material to the wall surface of the coking chamber in the coke battery according to claim 4, wherein a plurality of carrier rollers are provided to support the horizontal lance for movement back and forth outside the coke battery.

* * * * *